United States Patent [19]

Taggart

[11] Patent Number: 5,040,252

[45] Date of Patent: Aug. 20, 1991

[54] BATHTUB COVER

[76] Inventor: John F. Taggart, 1707 E. 52nd St., Brooklyn, N.Y. 11234

[21] Appl. No.: 417,060

[22] Filed: Oct. 4, 1989

[51] Int. Cl.[5] ..... A47K 3/02; A47K 3/06

[52] U.S. Cl. ..... 4/580; 4/585

[58] Field of Search ..... 4/580, 581, 582, 583, 4/DIG. 18, 584, 585, 559

[56] References Cited

U.S. PATENT DOCUMENTS

| | | | |
|---|---|---|---|
| 1,681,294 | 8/1928 | Henry | 4/DIG. 18 |
| 2,143,267 | 1/1939 | Hall | 4/580 |
| 2,319,603 | 5/1943 | Henry | 4/580 |
| 2,853,714 | 9/1958 | Darmstadt | 4/580 |
| 3,119,122 | 1/1962 | Weisbeck | 4/580 |
| 3,460,167 | 8/1969 | Benjamin | 4/580 |
| 4,312,084 | 1/1982 | Browning | 4/538 |

*Primary Examiner*—Henry J. Recla
*Assistant Examiner*—David J. Walczak
*Attorney, Agent, or Firm*—Michael I. Kroll

[57] ABSTRACT

A cover for a conventional bathtub is disclosed. A removably mountable side flap protects the side of the conventional bathtub. A removably mountable top part protects the top of the conventional bathtub. A removably mountable internal part protects the internal part of the conventional bathtub, VELCRO ® in use for removably mounting the side flap, if necessary, the top part, if necessary, the internal part if necessary, to the bathtub and to each other if necessary, so that whenever the bathtub is in the threat of danger the VELCRO ® provide contact points for the side flap, the top part, and the internal part and are the vulnerable areas on the conventional bathtub.

3 Claims, 3 Drawing Sheets

Fig. 1B
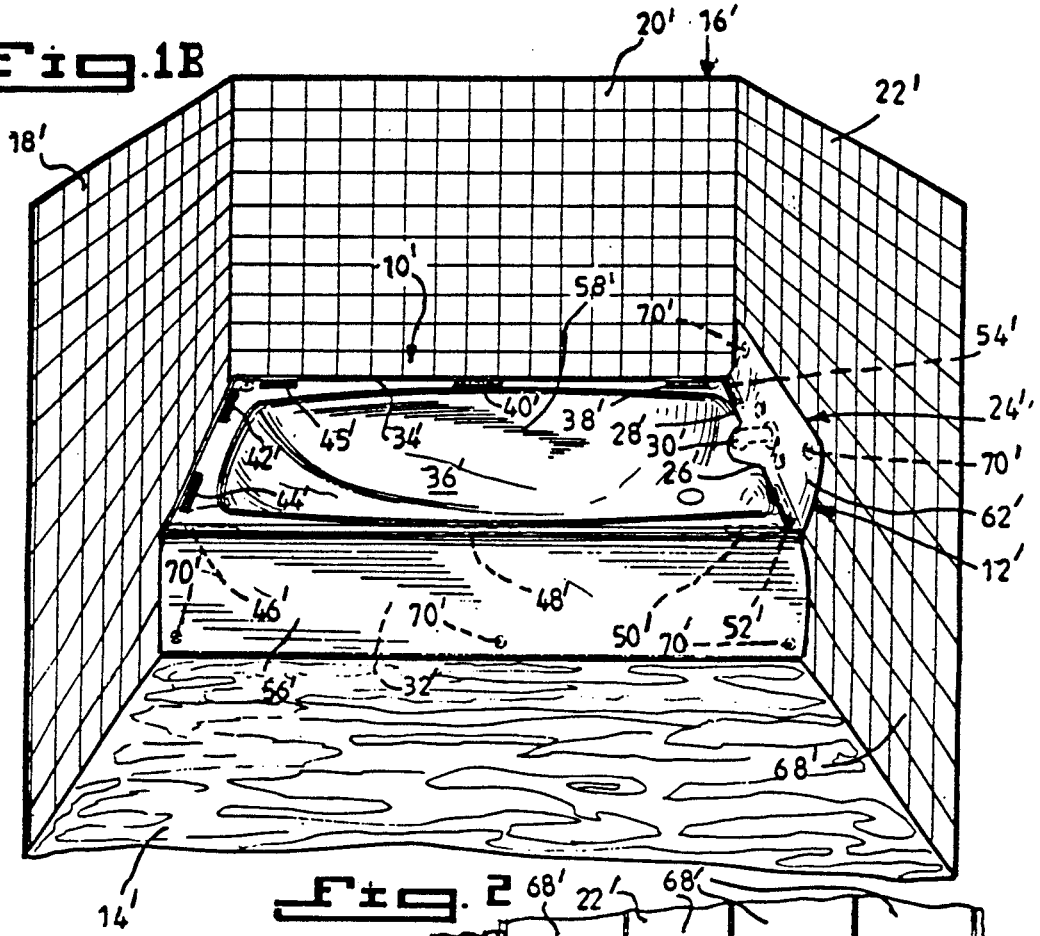
Fig. 2
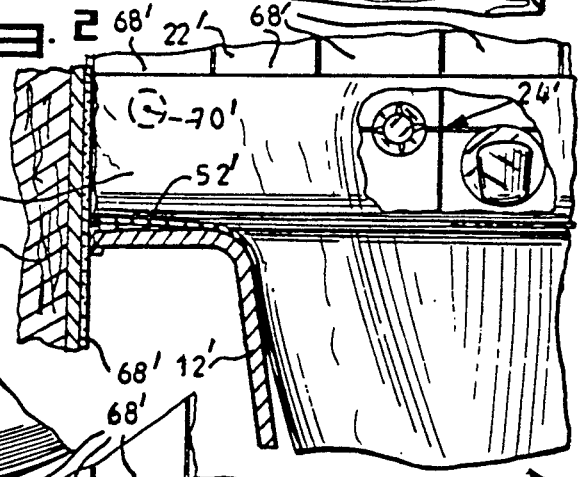
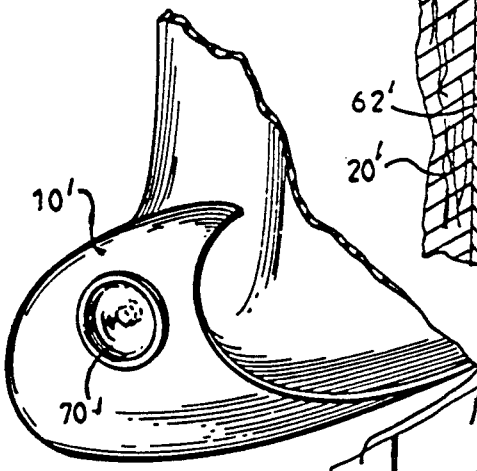
Fig. 3
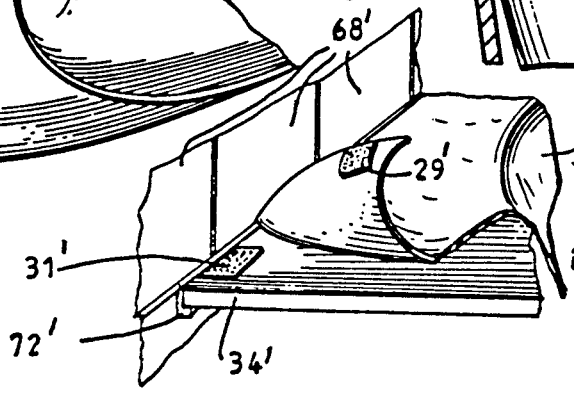
Fig. 4

Fig. 5
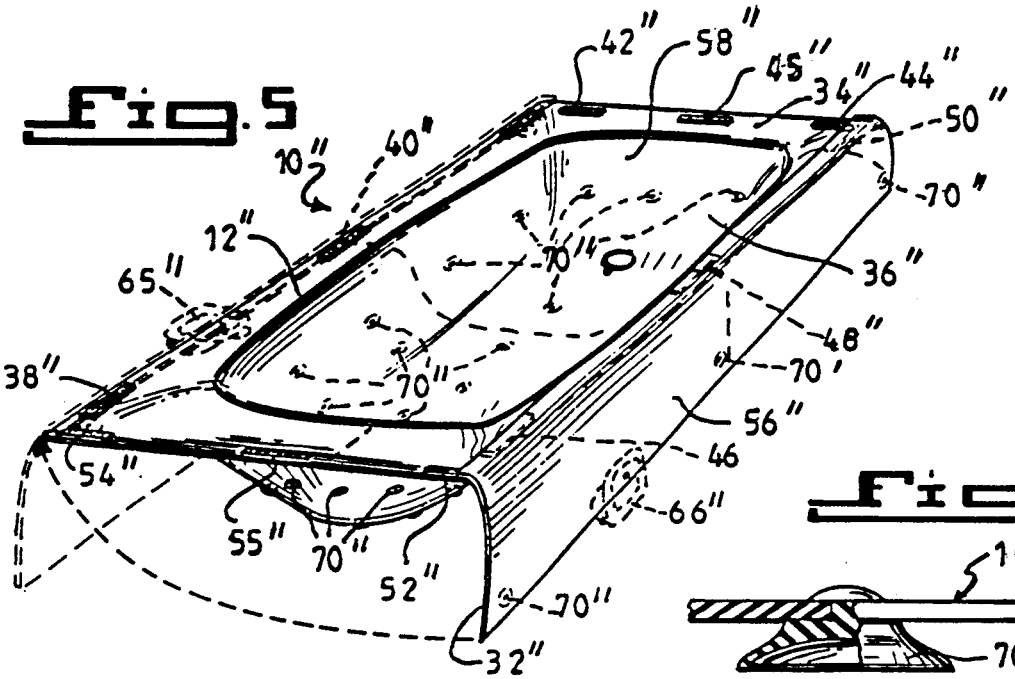
Fig. 6
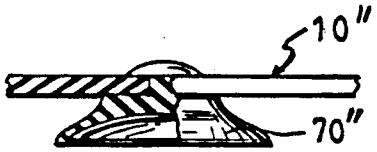
Fig. 7
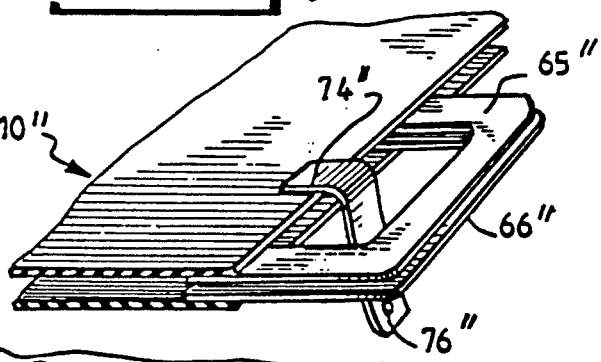
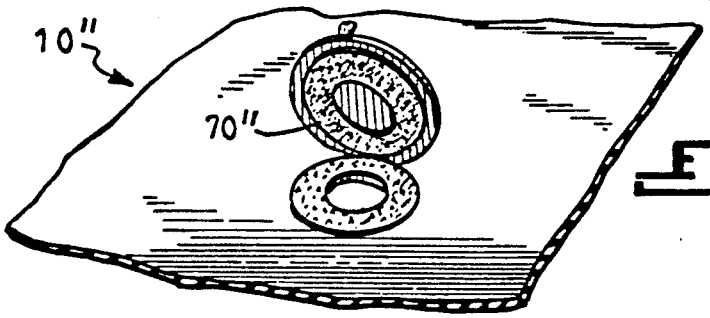
Fig. 8

BATHTUB COVER

BACKGROUND OF THE INVENTION

1. Field of the Invention

The present invention relates to a bathtub cover.

More particularly, the present invention relates to a cover for a bathtub that can be installed in sections and removed in sections so that only the areas needing protection would be covered.

2. Description of the Prior Art

Numerous innovations for bathtub liners have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a bathtub cover that avoids the disadvantages of the prior art.

More particularly, it is an object of the present invention to provide a cover for a bathtub that is made either of styrofoam or of rubber and which fits on and around the bathtub.

If the bathtub cover is made of disposable styrofoam it would be of one piece and be formed substantially like the shape of the bathtub needing protection.

If the bathtub cove is made of rubber it would be foldable so that it would be portable, compact and reusable.

The present invention has handles on both sides. VELCRO® strips and suction cups are used to hold the cover in place. Usually, because the bathtub is the first fixture to be placed in the bathroom, the chances for damage are greater.

The present invention can be used by both the general homeowner who makes minor repairs, and the general contractor who makes major repairs.

Also, the appropriate type of suction cups can be used to hold the cover in place at various points of the bathtub cover.

The present invention eliminates chips and scratches on the bathtubs that could occur from tools or materials falling into the bathtub; eliminates clogged drains caused by debris falling into the bathtub; eliminates paint stains, which quickens the contractor's time for clean-up; eliminates the expense of replacing a damaged bathtub; and eliminates repeatedly replacement of a bathtub ruined from debris, clogging, and paint stains, to name a few.

In keeping with these objects, and with others which will become apparent hereinafter, one feature of the present invention resides, briefly stated, in a cover for a conventional bathtub that has at least a side, a top, and an internal part and comprised of a removably mountable side flap for protecting the side of the conventional bathtub, a removably mountable to part for protecting the top of the conventional bathtub, a removably mountable internal part for protecting the internal part of the conventional bathtub wherein means are provided for removably mounting the side flap, if necessary, the top part, if necessary, the internal part, if necessary, to the bathtub and to each other, if necessary.

When the bathtub cover is designed in accordance with the present invention, whenever the bathtub is in the threat of danger, means provide contact points for the side flap, the top part, and the internal part of the vulnerable areas on the conventional bathtub.

In accordance with another feature of the present invention, the side flap is rubber.

Another feature of the present invention is that the top part is foldable rubber.

Yet another feature of the present invention is that the internal part is foldable rubber.

Still another feature of the present invention is that the side flap is styrofoam.

Yet still another feature of the present invention is that the top part is styrofoam.

Still yet another feature of the present invention is that the internal part is styrofoam.

Another feature of the present invention is that the removably mountable means include VELCRO® strips VELCRO® fasteners, and suction cups so that the necessary parts are removably mounted.

Yet another feature of the present invention is that it further comprises a faucet flap for protecting the faucet arrangement from damage.

Still another feature of the present invention is that the faucet flap is rubber, but not limited to it, so that the faucet arrangement is protected by the faucet flap.

The novel features which are considered characteristic for the invention are set forth in particular in the appended claims. The invention itself, however, both as to its construction and its method of operation, together with additional objects and advantages thereof will be best understood from the following description of the specific embodiments when read in connection with the accompanying drawing.

BRIEF DESCRIPTION OF THE DRAWING

FIG. 1B is a perspective view of the first alternate embodiment of the side cover of the bath tub cover of the present invention, using a front flap to protect the water faucet;

FIG. 2 is a front view of the front flap, with pieces broken away, and in the mounted position;

FIG. 3 is a perspective view of a typical suction cup attached to the bathtub cover of the present invention;

FIG. 4 is a perspective view of the bathtub cover of the present invention being affixed to the bathtub top, by using a VELCRO® fastener:

FIG. 5 is a perspective view of a second alternate embodiment of the bathtub cover of the present invention, showing a pair of handles, in phantom, for ease of transport;

FIG. 6 is a side view of a typical suction cup used in the bathtub cover of the present invention;

FIG. 7 is a perspective view of the bathtub cover of the present invention, showing the strap of the snap lock in the opened position; and FIG. 8 is a perspective view of the bath tub cover of the present invention, showing a typical suction cup in the opened position.

LIST OF REFERENCE NUMERALS UTILIZED IN THE DRAWING

10—bathtub cover of the present invention

Figure 1:
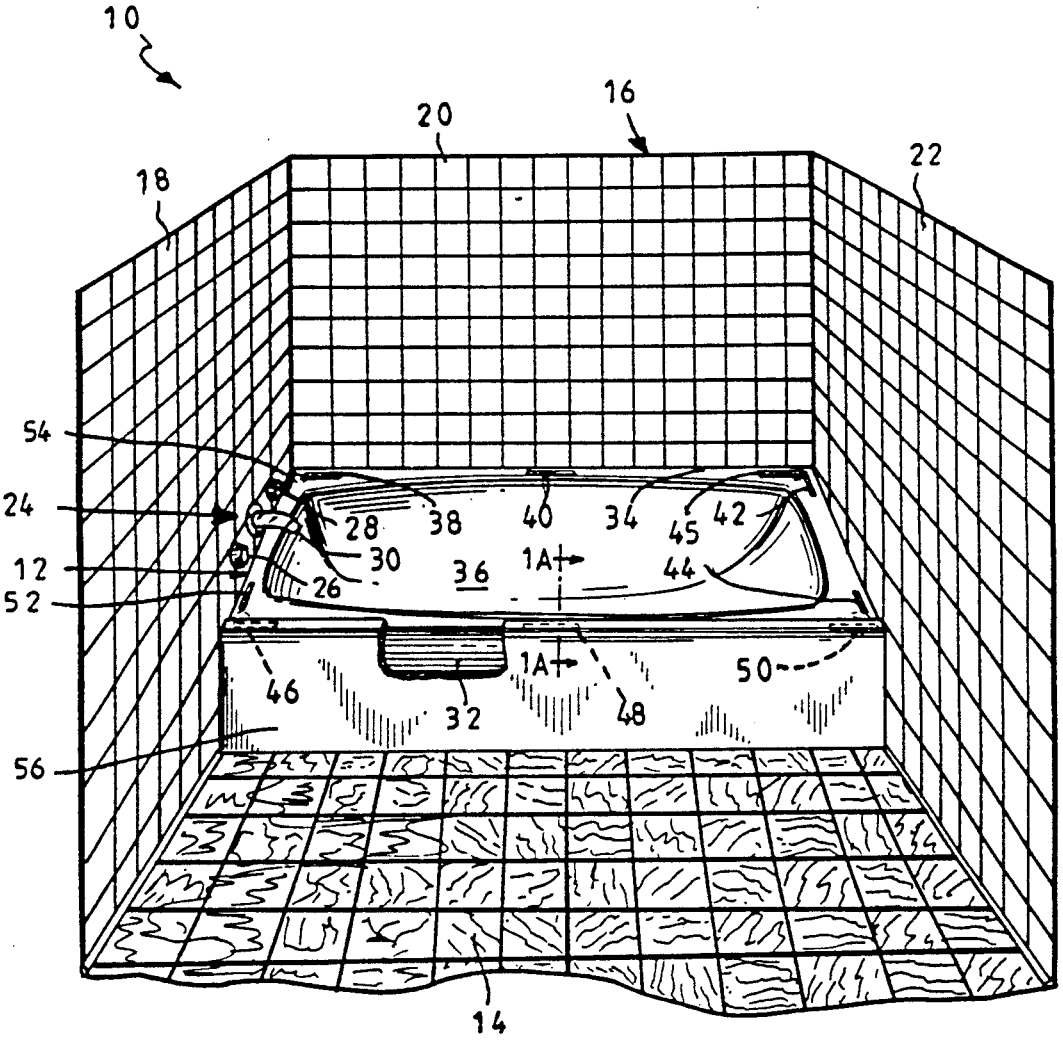
FIG. 1 is a perspective view of the side cover of the bathtub cover of the present invention, being used on a conventional bathtub.

12—conventional bathtub with the bathtub cover 10 affixed thereto
14—floor supporting the conventional bathtub 12
16—enclosure incompassing the conventional bathtub 12
18—first wall of the enclosure 16
20—second wall of the enclosure 16
22—third wall of the enclosure 16
24—faucet arrangement of the conventional bathtub 12
26—hot water faucet of the faucet arrangement 24
28—cold water faucet of the faucet arrangement 24
30—spout of the faucet arrangement 24
32—side of the conventional bathtub 12
34—top of the conventional bathtub 12
36—internal part of the conventional bathtub 12
38—VELCRO ® strip adjacent to the second wall 20
40—VELCRO ® strip adjacent to the second wall 20
42—VELCRO ® strip adjacent to the third wall 22
44—VELCRO ® strip adjacent to the third wall 22
45—VELCRO ® strip adjacent to the second wall 20
46—VELCRO ® fastener adjacent to the first wall 18
48—VELCRO ® fastener intermediate VELCRO ® fasteners 46 and 50
50—VELCRO ® fastener adjacent to the third wall 22
52—VELCRO ® strip on the end of the faucet arrangement 24
54—VELCRO ® strip on the end of the faucet arrangement 24
56—side rubber flap of bathtub cover 10
58—internal bathtub liner
60—first part of the VELCRO ® strip
10'—bathtub cover of the first alternate embodiment of the present invention
12'—conventional bathtub with the bathtub cover 10' affixed thereto
14'—floor supporting the conventional bathtub 12'
16'—enclosure incompassing the conventional bathtub 12'
18'—first wall of the enclosure 16'
20'—second wall of the enclosure 16'
22'—third wall of the enclosure 16'
24'—faucet arrangement of the conventional bathtub 12'
26'—hot water faucet of the faucet arrangement 24'
28'—cold water faucet of the faucet arrangement 24'
29'—VELCRO ® strip
30'—spout of the faucet arrangement 21'
31'—VELCRO ® strip
32'—side of the conventional bathtub 12'
34'—top of the conventional bathtub 12'
36'—internal part of the conventional bathtub 12'
38'—VELCRO ® strip adjacent to the second wall 20'
40'—VELCRO ® strip adjacent to the second wall 20'
42'—VELCRO ® strip adjacent to the first wall 18'
44'—VELCRO ® strip adjacent to the first wall 18'
45'—VELCRO ® strip adjacent to the second wall 20'
46'—VELCRO ® fastener adjacent to the first wall 18'
48'—VELCRO ® fastener intermediate the VELCRO ® fasteners 46' and 50'
50'—fastener adjacent to the third wall 22'
52'—VELCRO ® strip on the end of the faucet arrangement 24'
54'—VELCRO ® strip on the end of the faucet arrangement 24'
56'—side rubber flap of the bathtub cover 10'
58'—internal bathtub liner
62'—front flap
68'—tiles
70'—typical suction cup used throughout the present invention, where necessary
72'—lip
10''—bathtub cover of the second alternate embodiment of the present invention
12''—conventional bathtub with the bathtub cover 10'' affixed thereto
32''—side of the conventional bathtub 12''
34''—top of the conventional bathtub 12''
36''—internal part of the conventional bathtub 12''
38''—VELCRO ® strip
40''—VELCRO ® strip
42''—VELCRO ® strip
44''—VELCRO ® strip
45''—VELCRO ® strip
46''—VELCRO ® fastener
48''—VELCRO ® fastener intermediate the VELCRO ® fasteners 46'' and 50''
50''—VELCRO ® fastener
52''—VELCRO ® strip
54''—VELCRO ® strip
55''—VELCRO ® strip
56''—side rubber flap of the bathtub cover 10''
58''—internal bathtub liner
65''—handle
66''—handle
70''—typical suction cups used throughout the present invention, where necessary
74''—strap
76''—snap lock

DETAILED DESCRIPTION OF THE PREFERRED EMBODIMENT

Figure 1A:
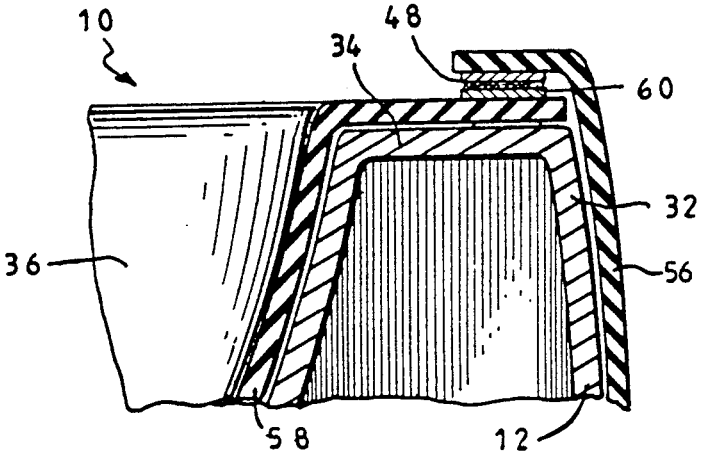
FIG. 1A is a cross-sectional view taken along line 1A—1A in FIG. 1.

Referring now to FIGS. 1 and 1A, the bathtub cover of the present invention is shown generally at 10, protecting a conventional bathtub 12 which is affixed on a floor 14 within an enclosure 16.

The enclosure 16 includes a first wall 18, a second wall 20, and a third wall 22.

The conventional bathtub 12 includes a faucet arrangement 24 which is disposed in the first wall 18 of the enclosure 16.

The faucet arrangement 24 contains a hot water faucet 26, a cold water faucet 28, and a spout 30.

The conventional bathtub 12, is one piece of homogeneous material, such as, fiberglass, metal, or porcelain, etc., to name a few, but is not limited to them.

The conventional bathtub 12 further includes a side 32, a top 34, and an internal part 36.

The bathtub cover 10 is affixed to the conventional bathtub 12 by VELCRO ® strips and VELCRO ® fasteners.

The side rubber flap 56 is removably mounted to the side 32 of the conventional bathtub 12, by the use of the VELCRO ® fasteners 46, 48, and 50, and thus, protecting the side 32 of the conventional bathtub 12.

It becomes necessary to also protect the top part 34 of the conventional bathtub 12, and the internal part 36 of the conventional bathtub 12. A top piece 58 of the bathtub cover 10 is affixed to the conventional bathtub 12 by the use of the VELCRO ® strips 38, 40, 42, 44, 45, 52, and 54, disposed on the top 34 of the conventional bathtub 12.

The bathtub cover 10, having the mating VELCRO ® strips (not shown) to the VELCRO ® strips, 38 40, 42, 44, 45, 52, and 54 mounted on the top 34 of the conventional bathtub 12, protects the top 34 and the internal part 36 of the conventional bathtub 12, against damage.

The side rubber flap 56 protects the side 32 of the conventional bathtub 12, against damage, while the bathtub cover 10 protects the top 34 and the internal part 36 of the conventional bathtub 12, against damage.

The cross-sectional view, taken along line 1A—1A in FIG. 1, depicts in detail, the side 32 of the conventional bathtub 12, using the bathtub cover 10 of the present invention, shown in FIG. 1A.

The internal bathtub liner 58 rests in the internal part 36 of the conventional bathtub 12, to prevent damage, while its ends protect the top 34 of the conventional bathtub 12, against damage. As can be seen, in FIG. 1, the VELCRO ® strips 38, 40, 42, 44, 45, 52, and 54 are disposed on the top 34 of the conventional bathtub 12, while the VELCRO ® fasteners 46, 48, and 50 have their first portion 60, mounted on to the internal bathtub liner 58.

Referring now to FIGS. 1B, 2, 3, and 4, the first alternate embodiment of the bathtub cover of the present invention is shown generally at 10', protecting a conventional bathtub 12' which is affixed on a floor 14' within an enclosure 16'.

The enclosure 16' includes a first wall 18', a second wall 20', and a third wall 22'.

The conventional bathtub 12' includes a faucet arrangement 24' which is disposed in the third wall 22' of the enclosure 16'.

The faucet arrangement 24' contains a hot water faucet 26', a cold water faucet 28', and a spout 30'.

The conventional bathtub 12', is one piece of homogeneous material, such as, fiberglass, metal, or porcelain, etc., to name a few, but is not limited to them.

The conventional bathtub 12' further includes a side 32', a top 34', and an internal part 36'.

The bathtub cover 10' is affixed to the conventional bathtub 12' by the use of VELCRO ® strips and VELCRO ® fasteners, and suction cups 70'.

The side rubber flap 56' is removably mounted to the side 32' of the conventional bathtub 12', by the use of the VELCRO ® fasteners 46', 48', and 50', and the suction cups 70', and thus, protecting the side 32' of the conventional bathtub 12'.

It becomes necessary to also protect the top part 34' of the conventional bathtub 12', and the internal part 36' of the conventional bathtub 12'. A top piece 58' of the bathtub cover 10' is affixed to the conventional bathtub 12' by the use of the VELCRO ® strips 38', 40', 42', 44', 45', 52', and 54' disposed on the top 34' of the conventional bathtub 12'.

The bathtub cover 10', having the mating VELCRO ® strips (not shown) to the VELCRO ® strips, 38', 40', 42', 44', 45', 52', and 54' mounted on the top 34' of the conventional bathtub 12', protects the top 34' and the internal part 36' of the conventional bathtub 12', against damage.

The side rubber flap 56' protects the side 32' of the conventional bathtub 12', against damage, while the bathtub cover 10' protects the top 34' and the internal part 36' of the conventional bathtub 12', against damage.

The internal bathtub liner 58' rests in the internal part 36' of the conventional bathtub 12', to prevent damage, while its ends protect the top 34' of the conventional bathtub 12', against damage.

As can be seen, in FIG. 1B, the VELCRO ® strips 38', 40', 42', 44', 45', 52', and 54' are disposed on the top 34' of the conventional bathtub 12', while the VELCRO ® fasteners 46', 48', and 50' have their first portions, mounted on.

The faucet arrangement 24' shown in FIG. 1B, is covered by a removably mounted front flap 62'. The front flap 62' includes two VELCRO ® fasteners 52' and 54', and two suction cups 70' that hold the front flap 62' against the tiles 68' of the third wall 22' of the conventional bathtub 12'.

The details of the faucet arrangement 24' can best be seen in FIG. 2. The front flap 62' is removably affixed by suction cups 70' to the tiles 68' of the third wall 22' and by VELCRO ® fasteners 52' and 54' to the top 34' part of the conventional bathtub 12'.

A typical suction cup 70' is shown, in FIG. 3, attached to the bathtub cover 10'.

A typical VELCRO ® loop strip is affixed to the bathtub cover 10'. A typical VELCRO ® hook strip is affixed to the top 34' of the bathtub 12. The typical VELCRO ® loop and hook strips become typical VELCRO ® fasteners, respectively.

As shown in FIG. 1, an "L"-shaped lip 72' helps hold the top part 34' of the conventional bathtub 12' to the second wall 16'.

Referring now to FIGS. 5, 6, 7, 8, 9, and 10, the second alternate embodiment of the bathtub cover of the present invention is shown generally at 10", protecting a conventional bathtub 12".

The conventional bathtub 12", is one piece of homogeneous material, such as, fiberglass, metal, or porcelain, etc., to name a few, but is not limited to them.

The conventional bathtub 12" further includes a side 32", a top 34", and an internal part 36".

The bathtub cover 10" is affixed to the conventional bathtub 12" by the use of VELCRO ® strips, VELCRO ® fasteners, and suction cups 70".

The side rubber flap 56" is removably mounted to the side 32" of the conventional bathtub 12", by the use of the VELCRO ® fasteners 46", 48", and 50", and the suction cups 70". Thus, protecting the side 32" of the conventional bathtub 12".

It becomes necessary to also protect the top part 34" of the conventional bathtub 12", and the internal part 36" of the conventional bathtub 12". A top piece 58" of the bathtub cover 10" is affixed to the conventional bathtub 12" by the use of the VELCRO ® strips 38", 40", 42", 44", 45", 52", 54", and 55" disposed on the top 34" of the conventional bathtub 12".

The bathtub cover 10", having the mating VELCRO ® strips (not shown) to the VELCRO ® strips, 38", 40", 42", 44", 45", 52", 54", and 55" mounted on the top 34" of the conventional bathtub 12", protects the top 34" and the internal part 36" of the conventional bathtub 12", against damage.

The side rubber flap 56" protects the side 32" of the conventional bathtub 12", against damage, while the bathtub cover 10" protects the top 34" and the internal part 36" of the conventional bathtub 12", against damage.

The internal bathtub liner 58" is attached to the internal part 36" of the conventional bathtub 12", to prevent damage, by the use of suction cups 70" while its ends protect the top 34" of the conventional bathtub 12", against damage. As can be seen, in FIG. 5, the VELCRO ® strips 38", 40", 45", 52", and 54" are disposed on the top 34" of the conventional bathtub 12", while the VELCRO ® fasteners 46", 48", and 50" have their first portions, mounted on the internal bathtub cover.

A typical VELCRO® loop strip is affixed to the bathtub cover 10″. A typical VELCRO® hook strip is affixed to the top 34″ of the bathtub 12″. The typical VELCRO® loop and hook strips become typical VELCRO® fasteners, respectively.

The second alternate embodiment of the bathtub cover 10″, includes VELCRO® strips 38″, 40″, 42″, 44″, 45″, 52″, and 54″ and VELCRO® fasteners 46″, 48″, and 50″. This embodiment utilizes VELCRO® strips and fasteners and suction cups 70″ for assembly. The front flap is removed and replaced by handles 65″ and 66″.

A typical suction cup 70″ is shown in FIG. 6 and FIG. 10 affixed to the bathtub cover 56″.

To further ensure that the folded bathtub cover 10″ stays together, a strap 74″ with a snap lock 76″ is further applied, as shown in FIG. 9.

In all three embodiments 10, 10′, and 10″, of the bathtub cover of the present invention, side flaps 56, 56′ and 56″, are each removably mounted to the conventional bathtubs 12, 12′, and 12″, respectively, so that the side flaps 56, 56′, and 56″ can be positioned on the conventional bathtubs 12, 12′, and 12″, respectively, regardless if the conventional bathtubs 12, 12′, and 12″ are right handed or left handed.

It will be understood that each of the elements described above, or two or more together, may also find a useful application in other types of constructions differing from the type described above.

While the invention has been illustrated and described as embodied in a bathtub cover, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A portable and reusable cover for a conventional bathtub that has at least a side, a top and an internal part, comprising:

a) a reusable removably mountable rubber side flap for covering only the side of the conventional bathtub and therefore protecting only the side of the conventional bathtub;

b) a reusable removably mountable foldable rubber top part for covering only the top of the conventional bathtub and therefore protecting only the top of the conventional bathtub;

c) a reusable removably mountable foldable rubber internal part for covering only the internal part of the conventional bathtub and therefore protecting only the internal part of the conventional bathtub; and d) means for removably mounting said rubber side flap, said foldable rubber top part and said foldable rubber internal part to the bathtub so that whenever the bathtub is in the threat of danger said means provide contact points for said rubber side flap, said foldable rubber top part and said foldable rubber internal part which are the vulnerable areas on the conventional bathtub, said removably mountable means include suction cups and VELCRO® fasteners which are made up of hook strips and loop strips so that the necessary parts are removably mounted, the mating surfaces of said hook strips and said loop strips of said VELCRO® fasteners being void of adhesive and adhesive protective peel off strips, said VELCRO® fasteners also providing adjustments so that the protecting cover can fit most sized bathtubs without any cutting and/or folding because of the long length of said hook strips and said loop strips of said VELCRO® fasteners, said hook strips and said loop strips can be moved in opposite directions to each other and yet still be able to touch each other and function as a fastener that is adjustable so that the protective cover can fit most sized bathtubs, said VELCRO® fasteners providing the rubber cover steadfast attachments to the bathtub that are not necessarily temporary if the user so desires, said cover protecting the bathtub from damage during demolition.

2. A cover as defined in claim 1, further comprising a faucet flap for protecting the faucet arrangement from damage.

3. A cover as defined in claim 2, wherein said faucet flap is rubber so that said faucet arrangement is protected by said faucet flap.

* * * * *